US007558515B2

(12) United States Patent
Kurita et al.

(10) Patent No.: US 7,558,515 B2
(45) Date of Patent: Jul. 7, 2009

(54) POWDER CONTAINER AND IMAGE FORMING APPARATUS

(75) Inventors: Masahiro Kurita, Kanagawa (JP); Misaki Uchiyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 424 days.

(21) Appl. No.: 10/571,914

(22) PCT Filed: Jul. 14, 2005

(86) PCT No.: PCT/JP2005/013430

§ 371 (c)(1),
(2), (4) Date: Mar. 14, 2006

(87) PCT Pub. No.: WO2006/006737

PCT Pub. Date: Jan. 19, 2006

(65) Prior Publication Data

US 2008/0240771 A1 Oct. 2, 2008

(30) Foreign Application Priority Data

Jul. 14, 2004 (JP) ..... 2004-207656
Jan. 26, 2005 (JP) ..... 2005-018321

(51) Int. Cl.
*G03G 15/08* (2006.01)

(52) U.S. Cl. ..... 399/262; 399/260

(58) Field of Classification Search ..... 399/260, 399/262, 263, 258
See application file for complete search history.

(56) References Cited

U.S. PATENT DOCUMENTS 4,614,165 A * 9/1986 Folkins et al.
4,878,603 A * 11/1989 Ikesue et al.
5,794,108 A 8/1998 Yoshizawa et al.
5,797,073 A * 8/1998 Russell ..... 399/260
5,867,757 A * 2/1999 Okazaki et al. ..... 399/262
5,878,307 A * 3/1999 Greenlaw et al. ..... 399/262
5,915,155 A 6/1999 Shoji et al.
6,125,243 A 9/2000 Shoji et al.
6,256,469 B1 7/2001 Taniyama et al.
6,289,195 B1 9/2001 Ichikawa et al.
6,298,208 B1 10/2001 Kawamura et al.

(Continued)

FOREIGN PATENT DOCUMENTS

EP 0 856 780 A1 8/1998

(Continued)

OTHER PUBLICATIONS

U.S. Appl. No. 12/186,906, filed Aug. 6, 2008, Someya, et al.

*Primary Examiner*—Susan S Lee
(74) *Attorney, Agent, or Firm*—Oblon, Spivak, McClelland, Maier & Neustadt, P.C.

(57) ABSTRACT

A powder container that is detachably installed in a container housing unit of an image forming apparatus includes a container body including an opening located at a head of the container body, and an engaging part located at a bottom of the container body, the engaging part being engaged with an engagement receiving part of the container housing unit; a drive transferring member that rotates integrally with the container body; and a lid including a discharge outlet that further discharges powder discharged from the opening of the container body, and a shutter that opens and closes the discharge outlet. A position of the powder container in the container housing unit is determined by engaging the engaging part with the engagement receiving part, and operating the lid such that the shutter opens the discharge outlet.

20 Claims, 13 Drawing Sheets

U.S. PATENT DOCUMENTS

| | | | | |
|---|---|---|---|---|
| 6,507,720 | B2 | 1/2003 | Kabumoto et al. | |
| 6,560,431 | B2 | 5/2003 | Hosokawa et al. | |
| 2004/0223790 | A1 * | 11/2004 | Hosokawa et al. | 399/258 |
| 2004/0258432 | A1 | 12/2004 | Hatori et al. | |
| 2004/0265011 | A1 | 12/2004 | Tsuda et al. | |
| 2008/0240771 | A1 | 10/2008 | Kurita et al. | |

FOREIGN PATENT DOCUMENTS

| | | | |
|---|---|---|---|
| EP | 1 403 733 | A1 | 3/2004 |
| JP | 06-043754 | | 2/1994 |
| JP | 10-048936 | | 2/1998 |
| JP | 11-133713 | | 5/1999 |
| JP | 11-272050 | | 10/1999 |
| JP | 2000-214669 | | 8/2000 |
| JP | 2000-305346 | | 11/2000 |
| JP | 2000-338758 | | 12/2000 |
| JP | 2002-221858 | | 8/2002 |
| JP | 2003-233248 | A | 8/2003 |
| JP | 2004-139031 | | 5/2004 |

* cited by examiner

POWDER CONTAINER AND IMAGE FORMING APPARATUS

TECHNICAL FIELD

The present invention relates to a powder container that is detachably attached to a body of an image forming apparatus to replenish powder such as toner consumed during an image forming process, and an image forming apparatus including the powder container.

BACKGROUND ART

An image forming apparatus such as a composite machine has at least two functions of a printer, a copier, or a fax machine. Toner is consumed when the image forming apparatus is used; thus, the toner needs to be successively replenished into a developing unit according to the amount of consumption. The toner is typically replenished into the developing unit from a toner container such as a toner cartridge or a toner bottle. When the toner container is empty, it is replaced with a new one.

There is known a cylindrical toner bottle for replenishing toner into the developing unit of the conventional image forming apparatus, such as that disclosed in Japanese Patent Application Laid Open No. 2000-338758 (hereinafter referred to as "first document").

In the first document, the toner bottle is set in the body of the image forming apparatus (hereinafter, "apparatus body") as follows.

First, a user pulls out a holding stand of a toner replenishing unit of the apparatus body, and takes out the empty bottle existing on the holding stand. The user then sets a new toner bottle sideways in the holding stand. The user pushes the holding stand with the new toner bottle into the back of the toner replenishing unit. Accordingly, a convex part provided on the bottom of the toner bottle engages with a joint part at the back of the toner replenishing unit. This fixes the position of the toner bottle in the toner replenishing unit.

Spiral protrusions are provided on the inner circumferential surface of the toner bottle. Thus, when the joint part is rotatably driven and the toner bottle is rotated, toner contained in the toner bottle is discharged from an opening. The toner discharged from the toner bottle is replenished to the developing unit.

The toner bottle constructed as above is relatively low-cost in that fewer components are used as compared to a toner container with a conveying member such as an agitator inside. Moreover, the above toner bottle is useful for recycling purposes, because it has a higher level of mechanical strength as compared to a bag-shaped toner container.

Because a user exchanges the toner container, the toner container should be easy to exchange, and toner scattering should be prevented so as not to soil hands and clothes of the user. Moreover, toner density becomes uneven if a stable amount of toner is not constantly discharged from the toner container and replenished into the developing unit. This can cause deterioration in image quality, such as blurring or uneven colors. Therefore, a stable amount of toner needs to be discharged from the toner container to the toner replenishing unit.

Various toner containers have been proposed and implemented to meet such demands. A well known example is a cylindrical toner bottle that has a spiral toner conveying part as disclosed in, for example, Japanese Patent Application Laid Open No. 2004-139031 (hereinafter referred to as "second document").

On one end of this toner bottle is a mouth (opening) that has a smaller diameter than the spiral-shaped bottle body. This toner bottle is set in the apparatus body so that the bottle axis is substantially horizontal. Moreover, this type of toner bottle discharges toner from the mouth (opening) by being rotated. Furthermore, the toner bottle can be set from above the apparatus, and a grasping part (handle) is provided on the toner bottle. Thus, a user can easily set the toner bottle only by using his fingers.

FIG. 20 is a diagram of the toner container with the grasping part (handle) and the spiral toner conveying part.

As shown in FIG. 20, a toner container 101 includes a cylindrical container body 102, a cylindrical discharge member (lid) 110 that is attached to a mouth (opening) 103 of the container body 102, and a grasping part (handle) 111 is provided on the discharge member (lid) 110. The container body 102 is connected to the discharge member (lid) 110 by engagement of a projecting part 104 along the outer circumference of the container body 102 near the mouth (opening) 103 with a claw part 112 formed on the discharge member (lid) 110. Accordingly, the discharge member (lid) 110 and the container body 102 can be rotated integrally. The projecting part 104 and the claw part 112 are to be engaged with a gap within a fit tolerance (about 0.01 mm to 0.2 mm) used in machine designing, so that the discharge member (lid) 110 and the container body 102 can be rotated. An elastic member 113 such as foamed polyurethane with a thickness of 3 mm is attached to the discharge member (lid) 110. Therefore, as the side surface of the mouth (opening) 103 of the container body 102 is pressed against the elastic member 113, toner is prevented from leaking from where the container body 102 and the discharge member (lid) 110 contact each other.

The container body 102 of the toner container 101 is rotatably driven by a gear 106. Accordingly, toner stored inside is conveyed towards the mouth (opening) 103 by force of a spiral toner conveying part 105, and the toner is discharged out of a replenishing opening (not shown) provided on the circumferential surface of the discharge member (lid) 110. To rotate the container body 102, a predetermined gap is provided in the cylindrical direction of the toner container 101 where the discharge member (lid) 110 overlaps with the container body 102 (in the example in FIG. 21, a 2 mm gap is provided in a radial direction). In other words, the toner container 101 is provided with a gap $\Delta L$ of substantially 2 mm in the radial direction where the discharge member (lid) 110 overlaps with the container body 102.

However, in the conventional technology disclosed in the first document, a user cannot clearly feel a mechanical click when attaching the toner bottle to the apparatus body. Thus, there is a possibility that the toner bottle is not set properly.

Specifically, when the user sets the toner bottle on the holding stand pulled out from the toner replenishing unit, the user cannot feel safe and sure that the toner bottle is set properly. Only after the user pushes the holding stand with the toner bottle into the toner replenishing unit, the user can feel safe and sure that the toner bottle is set properly.

This means that there is a possibility that the toner bottle is not set properly when the toner bottle is being set on the holding stand. If the holding stand is pushed into the toner replenishing unit with the toner bottle not properly set, components of the toner replenishing unit or the toner bottle can break. Moreover, if the toner bottle does not engage with the joint, toner might not be replenished properly.

The toner container with the grasping part (handle) and the spiral toner conveying part disclosed in the second document has the following problem. When a user sets the toner container 101 shown in FIGS. 20, 21 into the image forming apparatus, the user holds it with the grasping part (handle) 111 to hold the whole toner container. The grasping part (handle) 111 is located on the discharge member (lid) 110 at one end of the toner container 101, and there is the gap within a fit tolerance between the toner container 101 and the discharge member (lid) 110. Thus, the toner container 101 is only held at one end, and the container body 102 tilts downward. In other words, because of the weight of the container body 102 including the toner stored, the bottom side opposite to the discharge member (lid) 110 tilts downward. As a result, a rotational central axis C1 of the container body 102 deviates from a central axis C2 of the discharge member (lid) 110, as shown in FIG. 21. In this state, the container body 102 can loosen from the discharge member (lid) 110, and a gap can be formed in between. If the toner container 101 is attached to the apparatus body in such state, toner leaks out and scatters from the loose part or the gap, by a shock caused by the attachment. In some cases, the toner might be saved from leaking from the loose part. However, if the rotational central axis of the container body 102 is tilted when the toner container 101 is attached to the apparatus body, the gear 106 deviates from the rotational central axis. This creates a fluctuation and increases a rotational torque of driving the apparatus body.

The present invention is made in view of the above. An object of the present invention is to provide a powder container and an image forming apparatus with which a user can clearly feel a mechanical click when attaching the container to the body of the image forming apparatus. Moreover, the object of the present invention is to ensure that the powder container is set properly, so that the rotational central axis of the container body is prevented from deviating from the central axis of the discharge member (lid part), to prevent powder scattering and a torque increase, with a simple construction. In other words, the object of the present invention is to provide a powder container and an image forming apparatus, such that the powder container is surely attached to the body of the image forming apparatus.

DISCLOSURE OF INVENTION

It is an object of the present invention to at least solve the problems in the conventional technology.

A powder container according to one aspect of the present invention, which is detachably installed in a container housing unit of an image forming apparatus, includes an opening located at a head of the container body, and an engaging part located at a bottom of the container body, the engaging part being engaged with an engagement receiving part of the container housing unit; a drive transferring member that rotates integrally with the container body; and a lid including a discharge outlet that further discharges powder discharged from the opening of the container body, and a shutter that opens and closes the discharge outlet. A position of the powder container in the container housing unit is determined by engaging the engaging part with the engagement receiving part, and operating the lid such that the shutter opens the discharge outlet.

An image forming apparatus according to another aspect of the present invention includes a powder container that includes a container body including an opening located at a head of the container body, and an engaging part located at a bottom of the container body, the engaging part being engaged with an engagement receiving part of the container housing unit; a drive transferring member that rotates integrally with the container body; and a lid including a discharge outlet that further discharges powder discharged from the opening of the container body, and a shutter that opens and closes the discharge outlet. A position of the powder container in the container housing unit is determined by engaging the engaging part with the engagement receiving part, and operating the lid such that the shutter opens the discharge outlet. The powder container is detachably installed in the container housing unit. The container housing unit includes the engagement receiving part with which the engaging part of the powder container is engaged.

A powder container according to still another aspect of the present invention includes a container body including a conveying part that conveys powder stored in the container body towards an opening of the container body; and a lid that supports the container body such that the container body is rotatable, and discharges the powder discharged from the opening through a discharge outlet. The lid includes a contacting part that makes a contact with the opening; and a preventing part that prevents a gap from forming between the opening and the contacting part. The powder container is installed in an image forming apparatus by fixing the lid to the image forming apparatus.

An image forming apparatus according to still another aspect of the present invention includes a powder container that includes a container body including a conveying part that conveys powder stored in the container body towards an opening of the container body; and a lid that supports the container body such that the container body is rotatable, and discharges the powder discharged from the opening through a discharge outlet. The lid includes a contacting part that makes a contact with the opening, and a preventing part that prevents a gap from forming between the opening and the contacting part. The powder container in which toner is contained can be installed the image forming apparatus. The powder container is installed in an image forming apparatus by fixing the lid to the image forming apparatus.

The other objects, features, and advantages of the present invention are specifically set forth in or will become apparent from the following detailed description of the invention when read in conjunction with the accompanying drawings.

BEST MODE(S) FOR CARRYING OUT THE INVENTION

Figure 1:
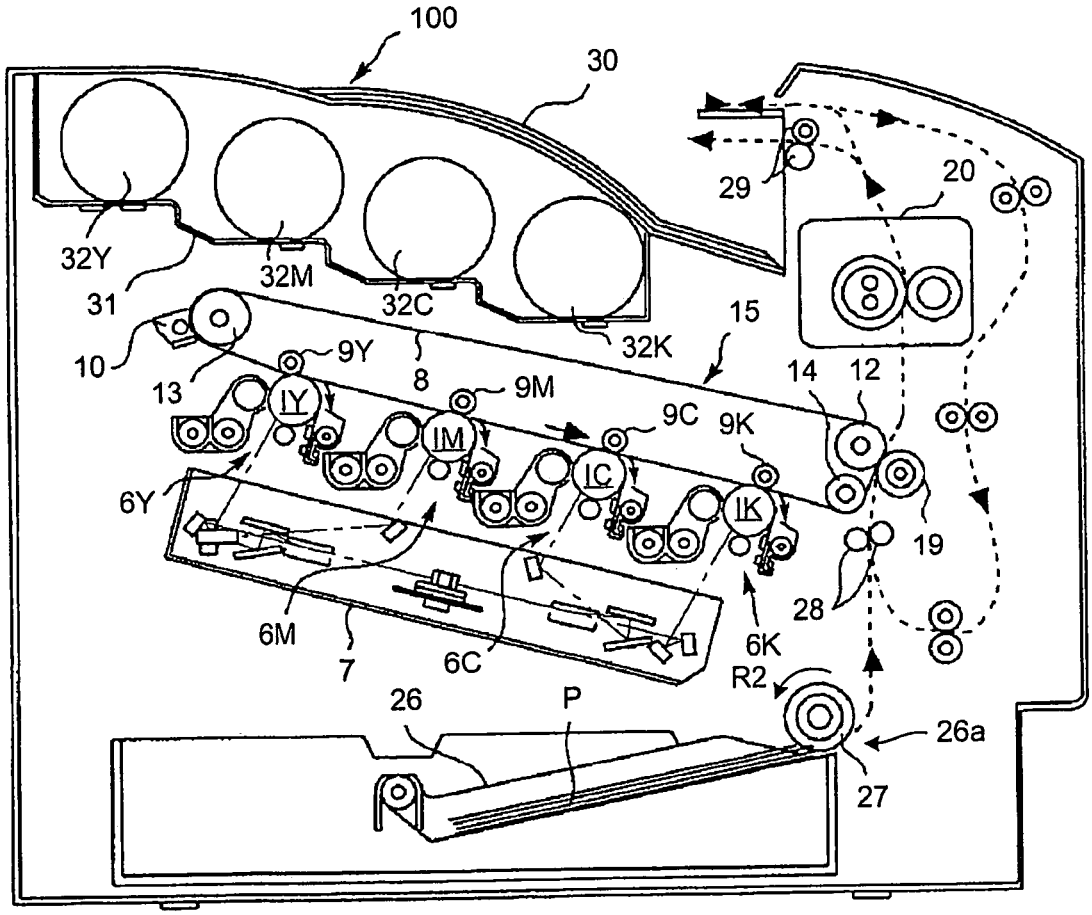
FIG. 1 is an overall diagram of an image forming apparatus according to a first embodiment and a second embodiment.

A powder container and an image forming apparatus that are best modes for carrying out the present invention will be described below in detail with reference to accompanying drawings. Common or corresponding components are denoted by the same reference numerals and overlapping descriptions are simplified or omitted. The present invention is not limited to these embodiments.

Figure 2:
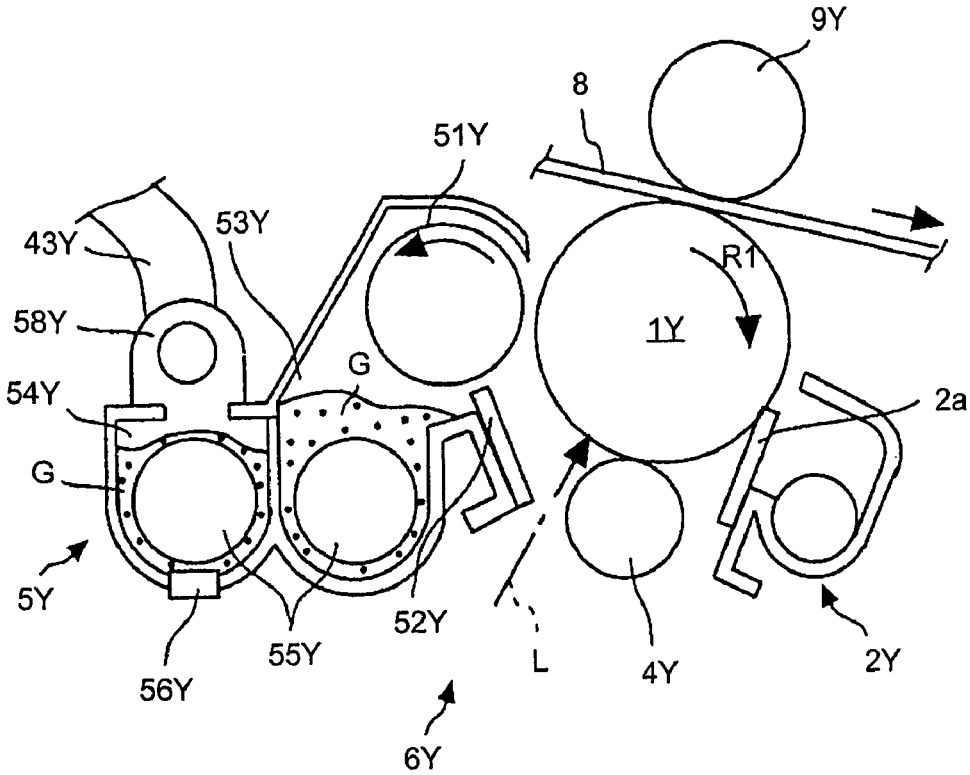
FIG. 2 is a cross-sectional view of an image forming unit in the image forming apparatus shown in FIG. 1.

An image forming apparatus according to a first embodiment is described below. FIG. 1 and FIG. 2 are diagrams for describing the overall construction and operations of the image forming apparatus. FIG. 1 is a diagram of a printer as the image forming apparatus and FIG. 2 is an enlarged diagram of an image forming unit in the printer.

As shown in FIG. 1, four toner bottles 32Y, 32M, 32C, and 32K corresponding to yellow, magenta, cyan, and black, respectively, are detachably set in a bottle housing unit 31 located at the top part in a body of the image forming apparatus (hereinafter, "apparatus body") 100.

An intermediate transfer unit 15 is provided below the bottle housing unit 31. Image forming units 6Y, 6M, 6C, and 6K corresponding to yellow, magenta, cyan, and black, respectively, are aligned facing an intermediate transfer belt 8 of the intermediate transfer unit 15.

As shown in FIG. 2, the image forming unit 6Y corresponding to yellow includes a photoconductive drum 1Y, and a charging unit 4Y, a developing unit 5Y, a cleaning unit 2Y, a destaticizing unit (not shown), and so forth, arranged around the photoconductive drum 1Y. An image forming process (charging step, exposing step, developing step, transferring step, cleaning step) is performed on the photoconductive drum 1Y, and a yellow image is formed on the photoconductive drum 1Y.

The three other image forming units 6M, 6C, and 6K have substantially the same construction as the image forming unit 6Y corresponding to yellow, except that each uses a different color toner and forms an different color image. Thus, descriptions of the three other image forming units 6M, 6C, and 6K are omitted, and only the image forming unit 6Y corresponding to yellow is described below.

As shown in FIG. 2, the photoconductive drum 1Y is rotatably driven by a driving motor (not shown) in a direction indicated by an arrow R1 in FIG. 2. The surface of the photoconductive drum 1Y is uniformly charged at the position of the charging unit 4Y (charging step).

Subsequently, at a position where a laser beam L is irradiated from an exposing unit 7 to the surface of the photoconductive drum 1Y, an electrostatic latent image for yellow is formed on the surface of the photoconductive drum 1Y by exposing/scanning (exposing step).

Subsequently, at a position where the surface of the photoconductive drum 1Y faces the developing unit 5Y, the electrostatic latent image is developed, and a yellow toner image is formed (developing step).

Subsequently, at a position where the surface of the photoconductive drum 1Y faces the intermediate transfer belt 8 and a first transfer-bias-roller 9Y, the toner image is transferred from the photoconductive drum 1Y to the intermediate transfer belt 8 (first transferring step). At this step, a marginal amount of toner is not transferred and remains on the photoconductive drum 1Y.

Subsequently, at a position where the surface of the photoconductive drum 1Y faces the cleaning unit 2Y, a blade 2*a* collects the toner remaining on the photoconductive drum 1Y (cleaning step).

Finally, at a position where the surface of the photoconductive drum 1Y faces the destaticizing unit (not shown), electric potential remaining on the photoconductive drum 1Y is removed.

Accordingly, the image forming process performed on the photoconductive drum 1Y ends.

The three other image forming units 6M, 6C, and 6K perform the same image forming process performed by the yellow image forming unit 6Y as described above. Specifically, in each of the image forming units 6M, 6C, and 6K, the laser beam L based on image information is irradiated from the exposing unit 7 provided below the image forming unit to the photoconductive drum. More specifically, the exposing unit 7 emits the laser beam L from a light source, reflects the laser beam L by rotating a polygon mirror, and irradiates the laser beam L onto the photoconductive drum through a plurality of optical elements.

Subsequently, each toner image formed on each photoconductive drum at the developing step is transferred on the intermediate transfer belt 8 so as to be superposed on each other. As a result, a full-color toner image is formed on the intermediate transfer belt 8.

As shown in FIG. 1, the intermediate transfer unit 15 includes the intermediate transfer belt 8, four first transfer-bias-rollers 9Y, 9M, 9C, and 9K, a second transfer back-up roller 12, a cleaning back-up roller 13, a tension roller 14, an intermediate-transfer cleaning-unit 10, and so forth. The intermediate transfer belt 8 is stretched across and supported by three rollers 12 to 14. Moreover, rotation of the second transfer back-up roller 12 causes the intermediate transfer belt 8 to rotate endlessly in a direction indicated by an arrow in FIG. 1.

Each of the four first transfer-bias-rollers 9Y, 9M, 9C, and 9K sandwiches the intermediate transfer belt 8 with each of the photoconductive drums 1Y, 1M, 1C, and 1K, respectively, forming first transfer nips. As a result, a transfer bias of a polarity opposite to that of toner is applied to each of the first transfer-bias-rollers 9Y, 9M, 9C, and 9K.

The intermediate transfer belt 8 rotates in the direction indicated by the arrow, and sequentially passes each of the first transfer nips of the first transfer-bias-rollers 9Y, 9M, 9C, and 9K. As a result, each toner image of the corresponding color on each photoconductive drum 1Y, 1M, 1C, and 1K is transferred (first transfer) and superposed onto the intermediate transfer belt 8.

Subsequently, at a position where the intermediate transfer belt 8 with the superposed toner images faces a second transfer roller 19, the second transfer back-up roller 12 sandwiches the intermediate transfer belt 8 with the second transfer roller 19, forming a second transfer nip. The full-color toner image formed on the intermediate transfer belt 8 is then transferred onto a transfer material P such as transfer paper that is conveyed to the second transfer nip. At this step, a marginal amount of toner is not transferred to the transfer material P and remains on the intermediate transfer belt 8.

Subsequently, at the intermediate-transfer cleaning-unit 10, the toner remaining on the intermediate transfer belt 8 is collected.

Accordingly, a transfer process performed on the intermediate transfer belt 8 ends.

The transfer material P conveyed to the second transfer nip is conveyed from a paper feed unit 26 located at the bottom part in the apparatus body 100, through a paper feeding roller 27 and a pair of registration rollers 28.

Specifically, a plurality of transfer materials P such as transfer paper is stacked in the paper feed unit 26. When the paper feeding roller 27 is rotatably driven in a direction indicated by an arrow R2 (anti-clockwise) in FIG. 1, the top transfer material P is fed from a paper feed port 26*a* towards the pair of registration rollers 28.

The pair of registration rollers 28 stops rotating so that the transfer material P stops in a roller nip of the pair of registration rollers 28. As the full-color image on the intermediate transfer belt 8 approaches the second transfer nip, the pair of registration rollers 28 starts rotating to convey the transfer material P into the second transfer nip in synchronization with the full-color toner image. At this time, a transfer bias (voltage) of a polarity opposite to that of the toner of the full-color toner image on the surface of the intermediate transfer belt 8 is applied to the second transfer roller 19. As a result, the full-color toner image on the surface of the intermediate transfer belt 8 is transferred at once onto the transfer material P. Accordingly, the intended color image is transferred onto the transfer material P.

After the color image is transferred onto the transfer material P at the second transfer nip, the transfer material P is conveyed to a fixing unit 20. In the fixing unit 20, a fixing roller and a pressurizing roller apply heat and pressure to the transfer material P to fix the transferred color image onto the transfer material P.

Subsequently, the transfer material P is conveyed outside the apparatus through a pair of paper ejecting rollers 29. A plurality of the transfer materials P ejected outside the apparatus by the pair of paper ejecting rollers 29 is sequentially stacked on a cover 30 as output images.

Accordingly, an image forming process performed by the image forming apparatus ends.

The above description is an image forming operation for forming a full-color image on the transfer material P. However, the image forming operation can be performed by using only one, two, or three of the image forming units 6Y, 6M, 6C, and 6K, to form a monochrome image, a 2-color image or a 3-color image.

Next, constructions and operations of the developing unit 5Y in the image forming unit 6Y is described in detail with reference to FIG. 2.

The developing unit 5Y includes a developing roller 51Y facing the photoconductive drum 1Y, a doctor blade 52Y facing the developing roller 51Y, two conveying screws 55Y provided inside developer containers 53Y, 54Y, a toner replenishing unit 58Y that communicates to the developer container 54Y through an opening, a density detecting sensor 56Y that detects a toner density in a developer, and so forth. The developing roller 51Y includes a magnet fixed inside, and a sleeve that rotates around the magnet, etc. A two-component developer including carriers and toner is stored in the developer containers 53Y, 54Y.

The developing unit 5Y with the above construction operates as follows.

The sleeve in the developing roller 51Y rotates in a direction indicated by an arrow in FIG. 2. The magnet in the developing roller 51Y forms a magnetic field. As the sleeve rotates, the magnetic field causes a developer carried on the developing roller 51Y to move on the developing roller 51Y.

In the developing unit 5Y, a proportion of toner included in the developer (toner density) is adjusted to be within a predetermined range. Specifically, as toner is consumed in the developing unit 5Y, the toner in the toner bottle 32Y is replenished into the developer container 54Y, through a toner conveying pipe 43Y of a toner conveying unit (see FIG. 12) and the toner replenishing unit 58Y. The constructions and operations of the toner bottle 32Y are described later in detail.

Subsequently, the toner replenished in the developer container 54Y is stirred and mixed with the developer by the two conveying screws 55Y, and is circulated to and fro the two developer containers 53Y, 54Y (movement in a horizontal direction as viewed in FIG. 2). The toner in the developer is friction-charged with the carriers so as to adhere to the carries. The toner adhering to the carriers is then carried on the developing roller 51Y by magnetic force on the developing roller 51Y.

The developer carried on the developing roller 51Y is conveyed in the direction indicated by the arrow in FIG. 2, and reaches a position facing the doctor blade 52Y. The amount of the developer carried on the developing roller 51Y is adjusted appropriately by the doctor blade 52Y. The appropriate amount of developer is then conveyed to a position facing the photoconductive drum 1Y (developing area). An electric field formed in the developing area causes toner to adhere to a latent image formed on the photoconductive drum 1Y. As the sleeve continues rotating, the developer remaining on the developing roller 51Y reaches the top part of the developer container 53Y, where the developer comes off the developing roller 51Y.

Next, the toner bottle that supplies toner to the developing device is described with reference to FIGS. 3 to 13.

As was described with FIG. 1, the four toner bottles 32Y, 32M, 32C, and 32K are detachably set in the bottle housing unit 31. At the end of a life of each toner bottle 32Y, 32M, 32C, and 32K (when almost all of the toner stored is consumed and the bottle is empty), the toner bottle is exchanged with a new toner bottle. Accordingly, toner of a color corresponding to each toner bottle 32Y, 32M, 32C, and 32K is replenished into the developing unit of each image forming unit 6Y, 6M, 6C, and 6K.

First, a construction of the toner bottle is described with reference to FIGS. 3 to 5.

Figure 3:
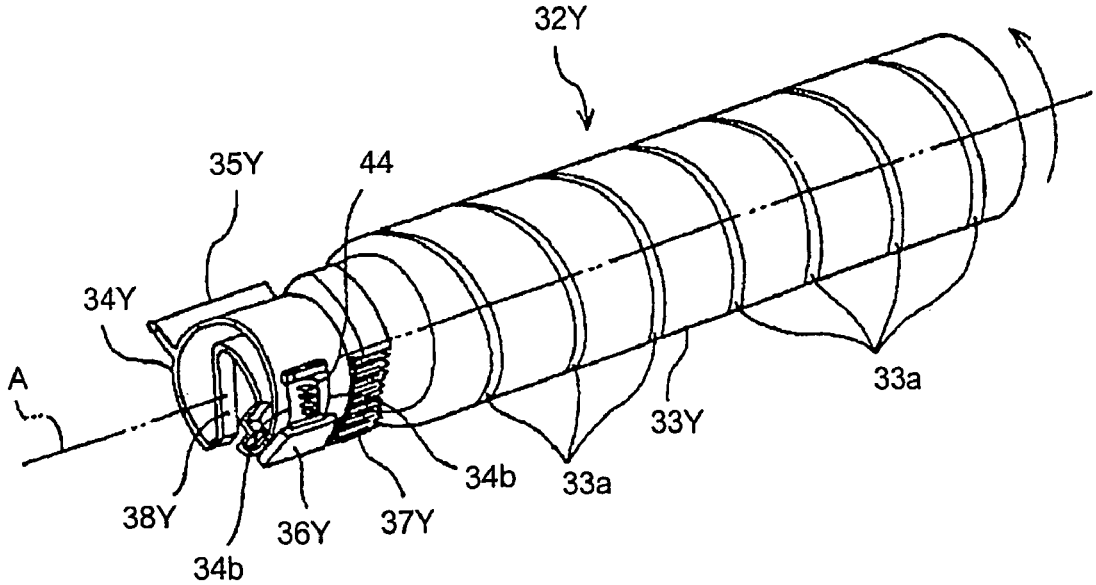
FIG. 3 is a perspective view of a toner bottle set in the image forming apparatus according to the first embodiment shown in FIG. 1.

FIG. 3 is a perspective view of the toner bottle 32Y. FIG. 4 is a perspective view of the toner bottle 32Y viewed from below. FIG. 5 is a cross-sectional view of the head side of the toner bottle 32Y.

The three other toner bottles 32M, 32C, and 32K have substantially the same construction as the toner bottle 32Y containing yellow toner, except that each contains a different color toner. Thus, descriptions of the three other toner bottles 32M, 32C, and 32K are omitted, and only the toner bottle 32Y containing yellow toner is described below.

As shown in FIG. 3, the main components of the toner bottle 32Y are a bottle body 33Y and a case 34Y (bottle cap) functioning as a lid provided on the head of the bottle body 33Y.

Figure 5:
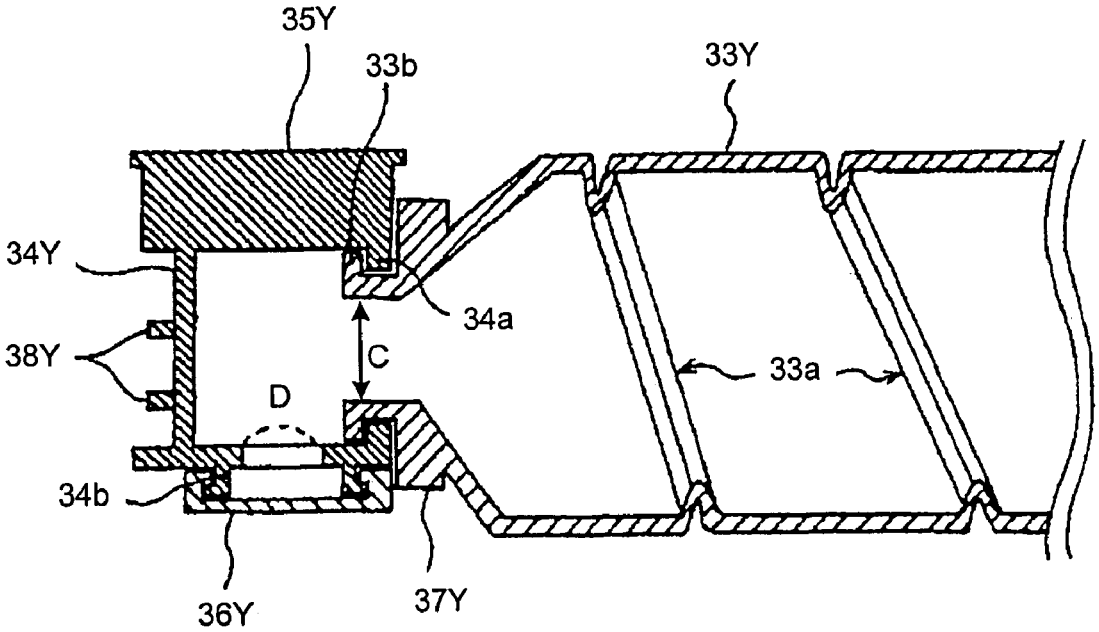
FIG. 5 is a cross-sectional view of a head side of the toner bottle according to the first embodiment shown in FIG. 3.

The head of the bottle body 33Y has a gear 37Y, as a drive transferring member, that rotates integrally with the bottle body 33Y, and an opening C (refer to FIG. 5). The gear 37Y meshes with a driving gear of the apparatus body 100 to rotate the bottle body 33Y in a direction indicated by an arrow, around a rotational axis A as shown in FIG. 3. Toner stored in the bottle body 33Y is discharged through the opening C to a space in the case 34Y.

Figure 4:
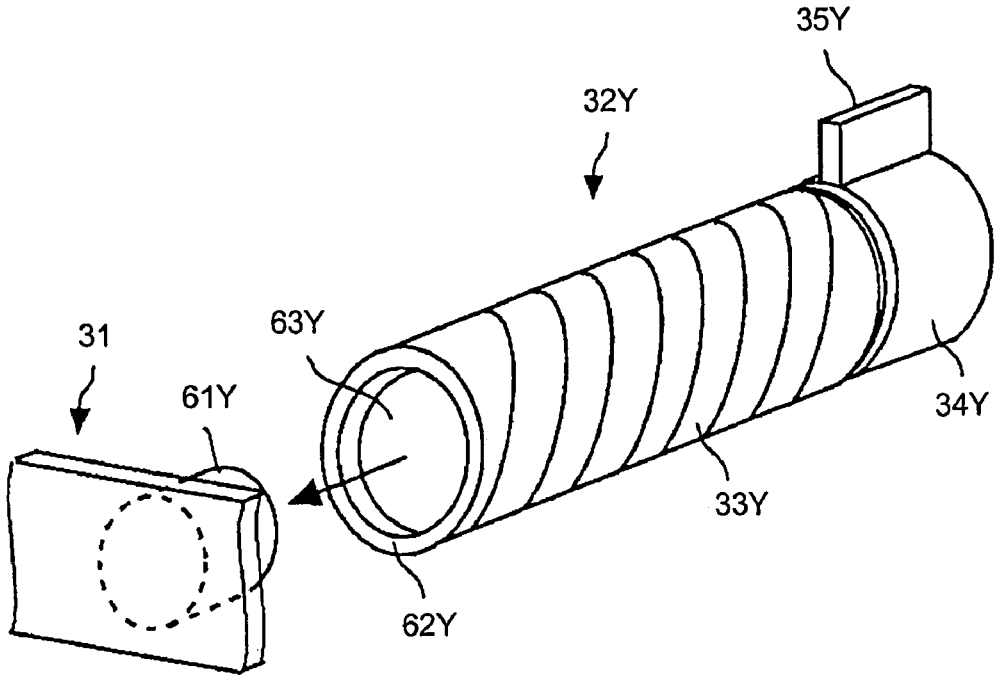
FIG. 4 is a perspective view from below of the toner bottle according to the first embodiment shown in FIG. 3.

As shown in FIG. 4, a concaving, circular engaging part 63Y is formed at a bottom part 62Y of the bottle body 33Y. The engaging part 63Y engages with a convex part 61Y formed on a side wall of the bottle housing unit 31.

As shown in FIG. 5, spiral protrusions 33*a* protrude from the outer circumferential surface into the inner circumferential surface of the bottle body 33Y. The spiral protrusions 33*a* are provided to rotate the bottle body 33Y to discharge toner out of the opening C.

The bottle body 33Y and the gear 37Y constructed as above can be manufactured by blow molding.

As shown in FIG. 3, a handle 35Y for manually rotating the case 34Y, a toner outlet D (refer to FIG. 5) for discharging toner from the toner bottle 32Y, and a shutter 36Y for opening and closing the toner outlet D, are provided on the circumferential surface of the case 34Y.

As shown in FIG. 5, the shutter 36Y engages with a guide part 34*b* on the case 34Y, and moves along the guide part 34*b* on the circumferential surface of the case 34Y, so as to open and close the toner outlet D. A spring 44 is provided on one end of the shutter 36Y. The urging force of the spring 44 causes the shutter 36Y to close the toner outlet D.

As shown in FIG. 3, on a side of the case 34Y is provided a fitting part 38Y, formed of long and short straight walls and a curved wall. The fitting part 38Y fits onto a convex part 39Y formed on another side wall of the bottle housing unit 31.

As shown in FIG. 5, a projection 34*a* of the case 34Y constructed as above is pushed in between the gear 37Y and a rim part 33*b* of the bottle body 33Y. In other words, the case 34Y and the bottle body 33Y are assembled to be relatively rotated with respect to each other in a circumferential direction. Accordingly, the case 34Y can be manually rotated when setting the bottle and the bottle body 33Y can be rotatably driven when replenishing toner, which will be described later.

Next, an operation for attaching/detaching the toner bottle 32Y to/from the bottle housing unit 31 is described with reference to FIGS. 6 to 11.

Figure 6:
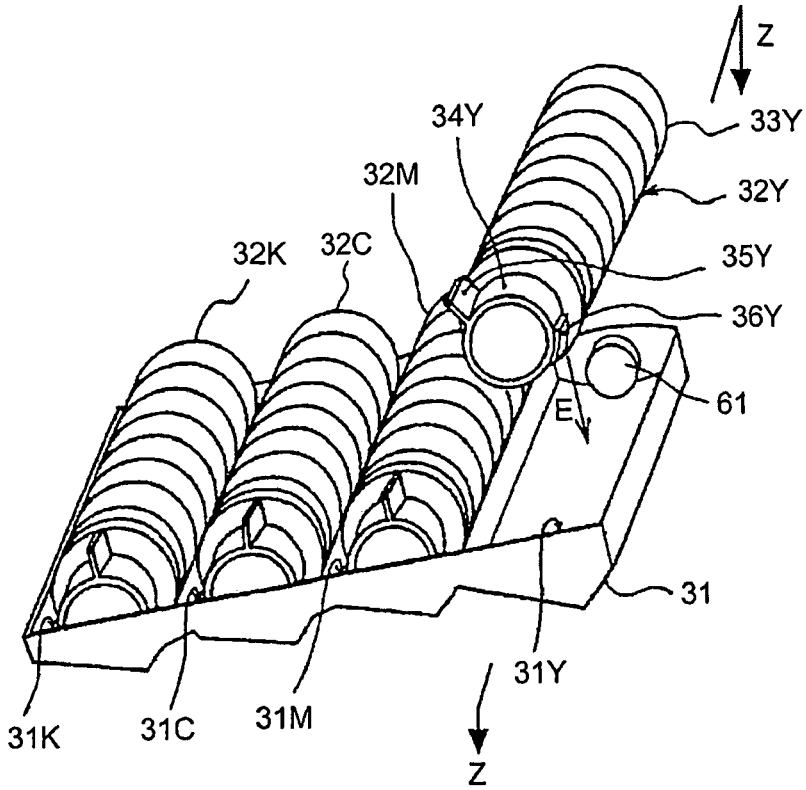
FIG. 6 is a perspective view of the toner bottle according to the first embodiment and the second embodiment, loaded onto a bottle housing unit.
Figure 7:
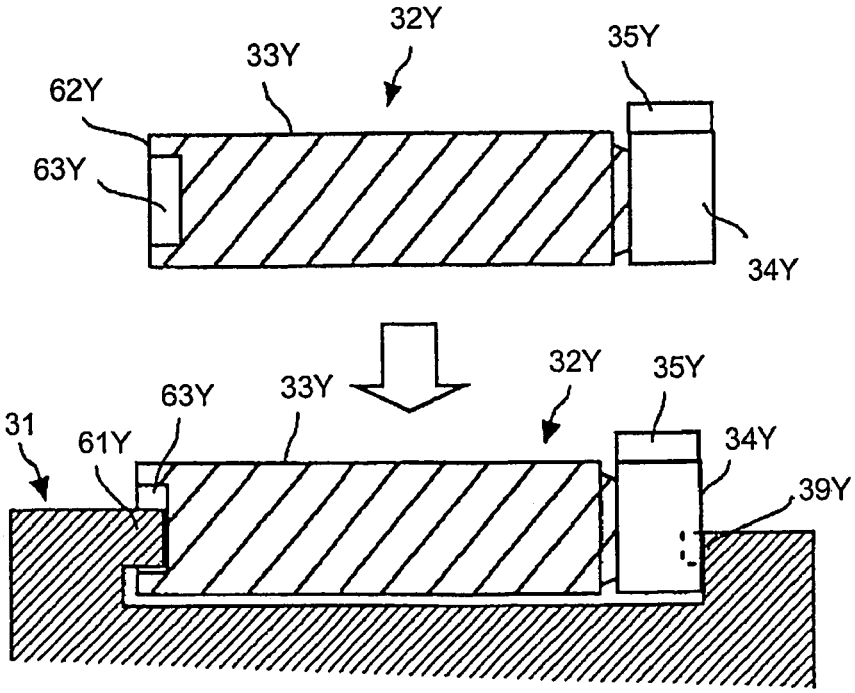
FIG. 7 is a cross-sectional view of the toner bottle according to the first embodiment being loaded onto the bottle housing unit.
Figure 9:
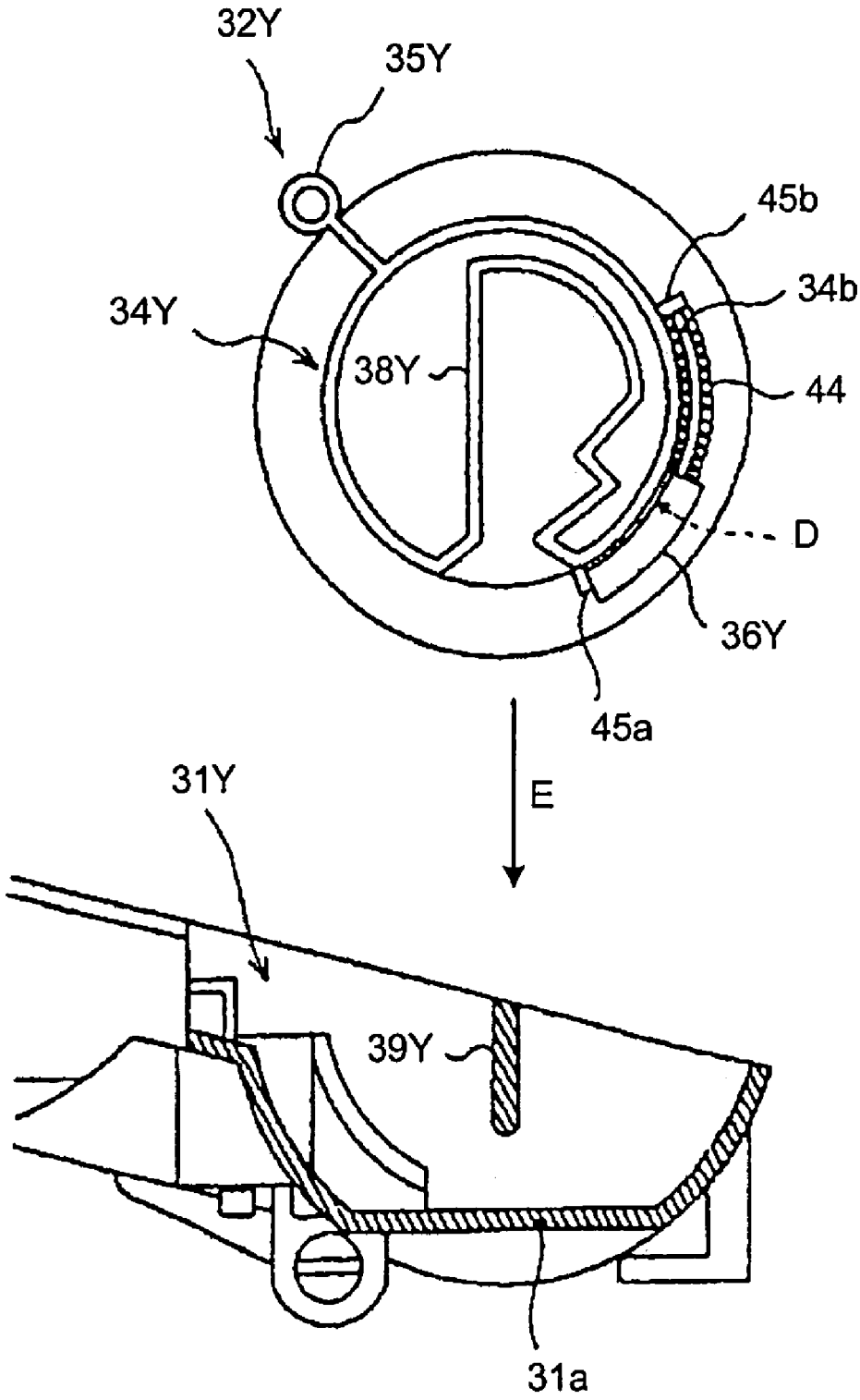
FIG. 9 is a front view of a case of the toner bottle according to the first embodiment being loaded onto the bottle housing unit.
Figure 10:
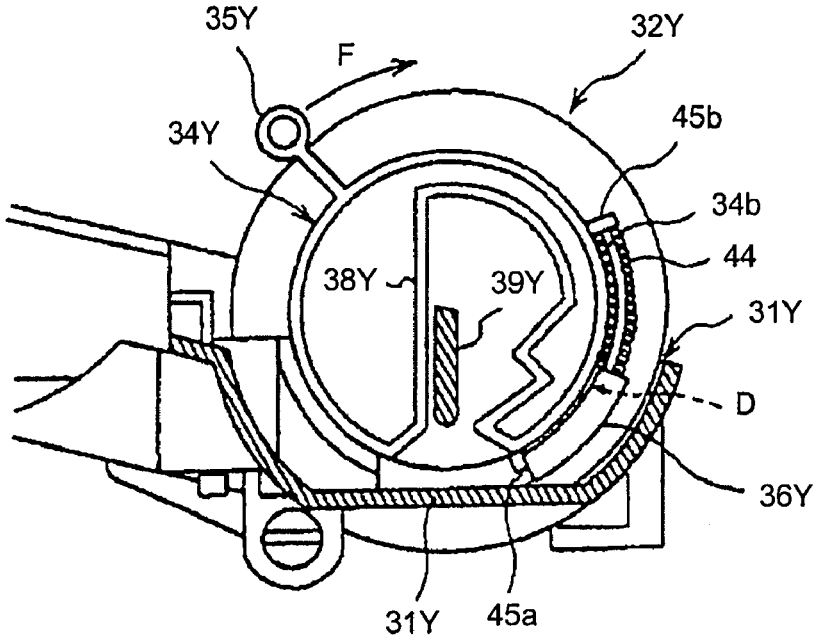
FIG. 10 is a front view of the case of the toner bottle according to the first embodiment shown in FIG. 9 being rotated on the bottle housing unit.
Figure 11:
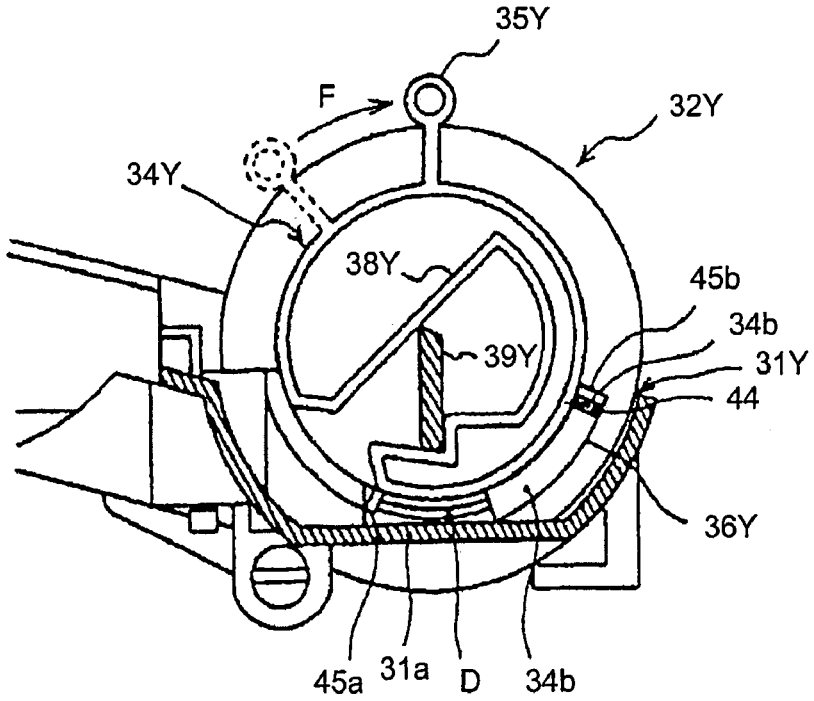
FIG. 11 is a front view of the case of the toner bottle according to the first embodiment shown in FIG. 10 after being rotated.

FIG. 6 is a perspective view of the yellow toner bottle 32Y loaded onto the bottle housing unit 31 (in a direction indicated by an arrow E). FIG. 7 is a cross-sectional view of FIG. 6 cut along a line Z-Z. FIGS. 9 to 11 are front views of motions of the case 34Y for setting the bottle.

As shown in FIG. 6, the bottle housing unit 31 has four bottle housing parts 31Y, 31M, 31C, and 31K corresponding to the four toner bottles 32Y, 32M, 32C, and 32K. Each of the four bottle housing parts 31Y, 31M, 31C, and 31K has the part 61 that engages with the engaging part of the bottle body, and the part (not shown) that fits with the fitting part of the case.

When attaching the toner bottle 32Y to the bottle housing unit 31 of the apparatus body 100, the cover 30 shown in FIG. 1 is firstly opened upwards to expose the bottle housing unit 31.

Subsequently, as shown in FIGS. 6 and 7, the toner bottle 32Y is mounted on the bottle housing part 31Y (in the direction indicated by the arrows). The toner bottle 32Y is set so that the engaging part 63Y on the bottom part 62Y of the bottle body 33Y engages with the part 61Y of the bottle housing part 31Y. At the same time, the toner bottle 32Y is set so that the straight wall of the fitting part 38Y provided on the side of the case 34Y slides along the part 39Y of the bottle housing part 31Y (refer to FIGS. 9 and 10). Accordingly, the toner bottle 32Y is fit in between the part 61Y and the part 39Y. This can restrict, to some extent, the toner bottle 32Y from trembling in a longitudinal direction.

Because the engaging part 63Y is concaved, the toner bottle 32Y can stand up with the bottom part 62Y at the bottom. This facilitates the process of filling toner into the toner bottle 32Y at a factory, and increases the degree of freedom in storing stock of toner bottles at a user's location, a factory, or a sales subsidiary.

Figure 8A:
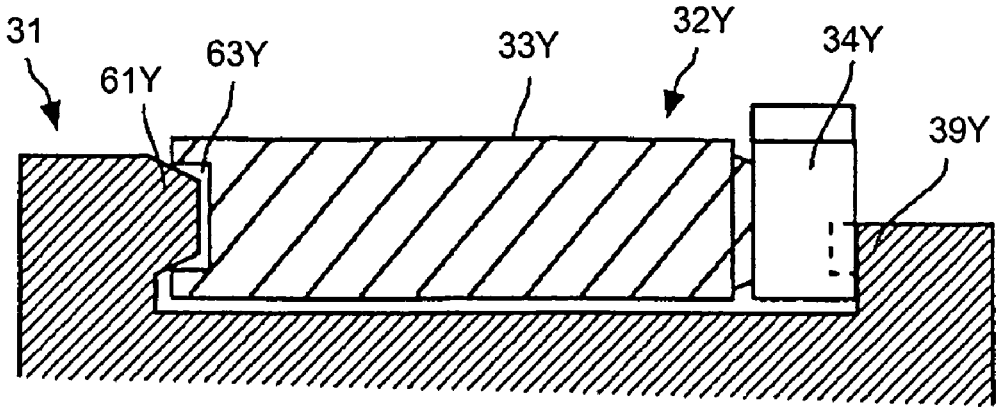
FIG. 8A is a cross-sectional view of the toner bottle according to the first embodiment loaded onto another example of the bottle housing unit.
Figure 8B:
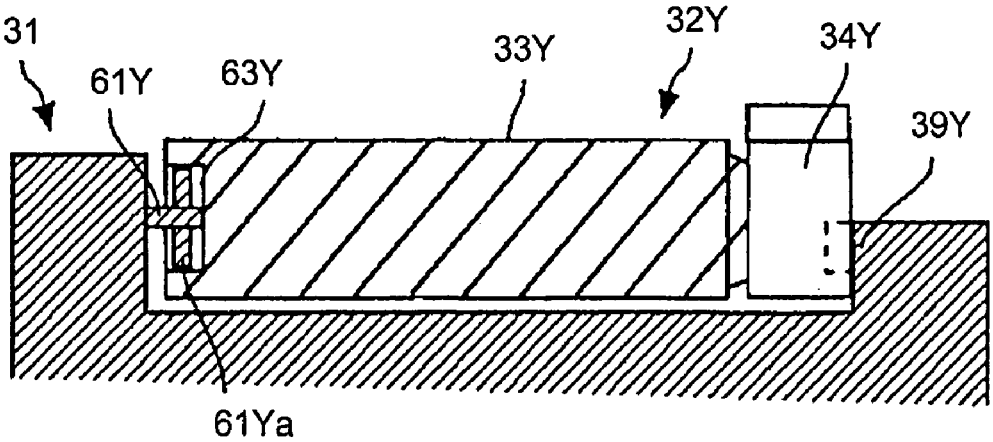
FIG. 8B is a cross-sectional view of the toner bottle according to the first embodiment loaded onto still another example of the bottle housing unit.

In the present embodiment, the part 61Y that is a cylindrical shape and the engaging part 63Y that is a concave circular shape are engaged, so that the bottom of the toner bottle 32Y does not lift from the wall of the bottle housing unit 31. However, the shapes of the part 61Y and the engaging part 63Y are not limited to these examples; for example, they can be shaped as shown in FIGS. 8A, 8B. In FIG. 8A, the part 61Y has a tapering shape that is engaged with the concave engaging part 63Y. In FIG. 8B, the part 61Y includes a plate 61Ya that is a circular disk or a cross-shaped disk that is engaged with the concave engaging part 63Y. Moreover, the engaging part 63Y can be a concave and tapering shape (not shown).

After the toner bottle 32Y is set as shown in FIG. 7, a user grasps the handle 35Y of the toner bottle 32Y, and rotates the case 34Y. Accordingly, the position of the toner bottle 32Y is finally set in the bottle housing part 31Y.

Motions of the case 34Y for setting the toner bottle 32Y are described below.

As shown in FIG. 9, the case 34Y is mounted so that the straight wall of the fitting part 38Y slides along the part 39Y of the bottle housing part 31Y (in a direction indicated by an arrow E). As described with FIGS. 6 and 7, the engaging part 63Y of the bottle body 33Y engages with the part 61Y of the bottle housing part 31Y.

When the toner bottle 32Y is set on the bottle housing part 31Y, the straight wall of the fitting part 38Y is in contact with the part 39Y of the bottle housing part 31Y, as shown in FIG. 10. The shutter 36Y of the case 34Y is urged by the spring 44 to a position that blocks the toner outlet D (locked at a position of a first stopper 45*a*).

From the position shown in FIG. 10, the handle 35Y is moved in a direction indicated by an arrow F. Accordingly, the case 34Y rotates in the direction indicated by the arrow F. The case 34Y stops rotating when a part of the wall of the fitting part 38Y is blocked by the part 39Y (as shown in FIG. 11).

The toner outlet D is rotated as the case 34Y is rotated, and finally stops at the bottom position (as shown in FIG. 11).

Moreover, rotation of the shutter 36Y is blocked by a stopping part 31*a* of the bottle housing part 31Y. Thus, an edge of the shutter 36Y presses against the spring 44 that is held by a second stopper 45*b* at one end, so that the shutter 36Y opens the toner outlet D.

As the shutter 36Y opens the toner outlet D when the case 34Y is rotated, the fitting part 38Y fits to the part 39Y, so that the position of the toner bottle 32Y is fixed in the bottle housing part 31Y.

Therefore, a user clearly feels a mechanical click when attaching the toner bottle 32Y, so that he knows that the toner bottle 32Y has been set. This prevents the user from failing to properly set the toner bottle 32Y. This prevents toner from not being replenished properly, and prevents components of the toner bottle 32Y and the bottle housing part 31Y from breaking.

Particularly, because the engaging part 63Y engages with the part 61Y at the bottom part 62Y of the toner bottle 32Y, the bottom part 62Y is prevented from lifting when the bottle body 33Y is rotatably driven. When the bottle body 33Y is rotatably driven, the engaging part 63Y and the part 61Y are rubbed against each other; therefore, the engaging part 63Y and the part 61Y are preferably made of a material with a low friction coefficient.

When the toner bottle 32Y is removed from the bottle housing part 31Y, a user performs a procedure opposite to the procedure of attaching the toner bottle 32Y. Specifically, the user rotates the handle 35Y of the toner bottle 32Y in the opposite direction (opposite to the direction indicated by the arrow F in FIG. 11). Accordingly, the fitting part 38Y of the case 34Y is released from the part 39Y of the bottle housing part 31Y. At the same time, the shutter 36Y moves relatively and closes the toner outlet D. The user holds the handle 35Y while he releases the engaging part 63Y from the part 61Y, and pulls out the toner bottle 32Y upwards.

Next, the toner conveying unit that conveys toner from inside the toner bottle 32Y set in the bottle housing unit 31 to the developing unit 5Y is described with reference to FIGS. 12 and 13.

Figure 12:
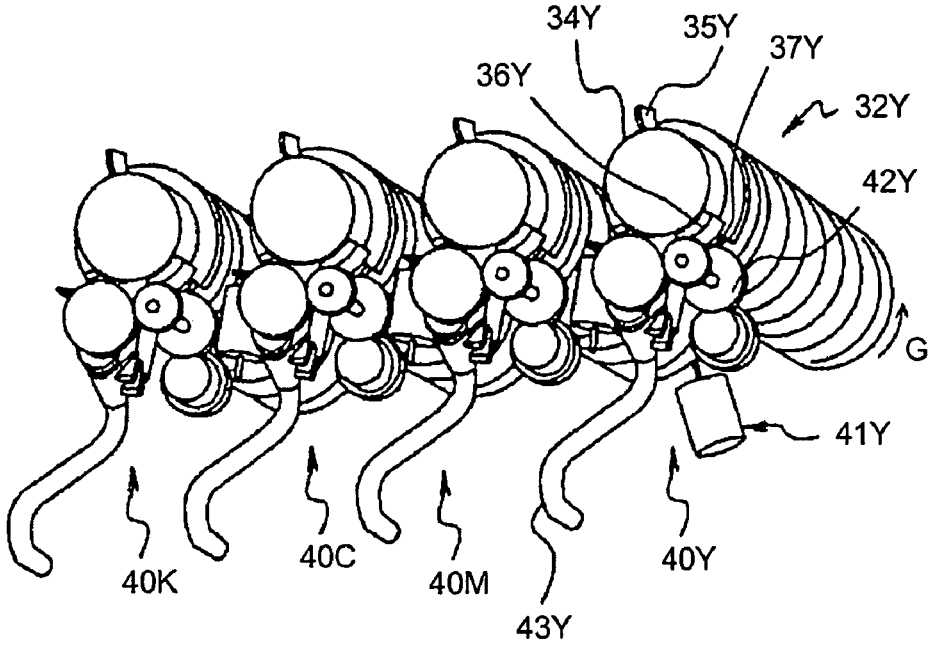
FIG. 12 is a perspective view of the toner bottles according to the first embodiment connected to toner conveying units.
Figure 13:
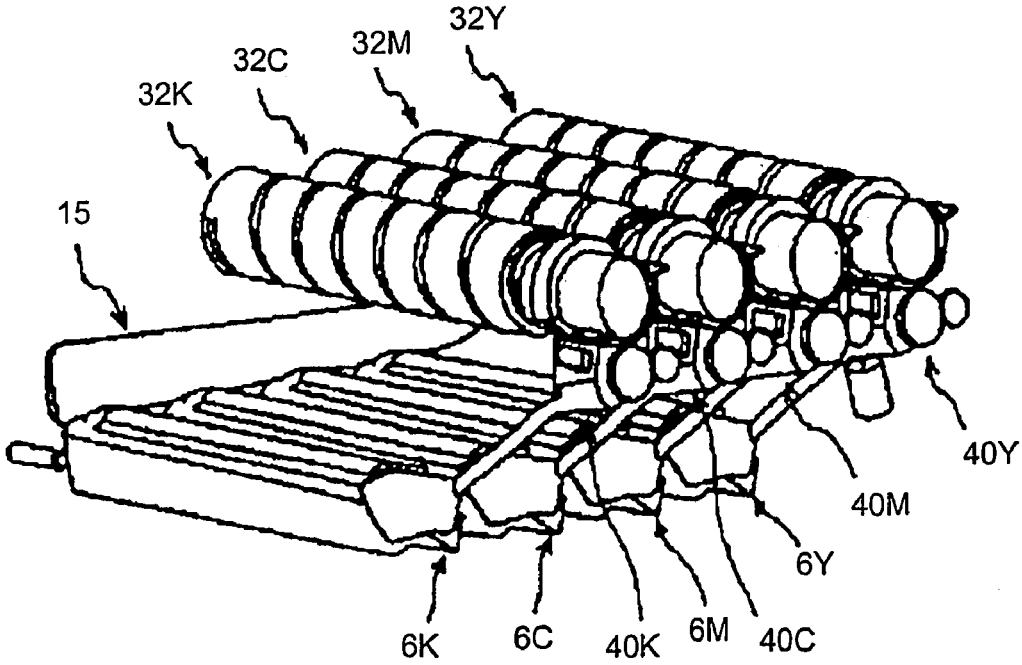
FIG. 13 is another perspective view of the toner bottles according to the first embodiment connected to the toner conveying units.

FIG. 12 is a front perspective view of the toner bottles 32Y, 32M, 32C, and 32K set in the bottle housing unit 31 and connected to toner conveying units 40Y, 40M, 40C, and 40K, respectively. FIG. 13 is a side perspective view of the toner bottles 32Y, 32M, 32C, and 32K connected to the toner conveying units 40Y, 40M, 40C, and 40K, respectively. The bottle housing unit 31 is omitted from FIGS. 12 and 13.

The toner conveying units 40Y, 40M, 40C, and 40K are fixed next to the intermediate transfer unit 15 (at the back of the apparatus body 100). The toner outlets of toner bottles 32Y, 32M, 32C, and 32K and the toner replenishing unit 58Y of the developing unit 5Y are positioned next to the intermediate transfer unit 15.

The four toner conveying units 40Y, 40M, 40C, and 40K have the same construction except that each conveys a different color toner. Thus, only the toner conveying unit 40Y for conveying yellow toner is described.

As shown in FIG. 12, the toner conveying unit 40Y mainly includes a driving motor 41Y and a driving gear 42Y functioning as a driving unit, and the toner conveying pipe 43Y. Inside the toner conveying pipe 43Y is a flexible conveying coil (not shown). The driving gear 42Y meshes with the gear 37Y (drive transferring member) of the toner bottle 32Y. Thus, when the driving gear 42Y is driven, the bottle body 33Y of the toner bottle 32Y is rotated.

The bottle body 33Y is rotated to discharge toner in accordance with consumption of toner in the developing unit 5Y. Specifically, when the density detecting sensor 56Y in the developing unit 5Y shown in FIG. 2 detects a shortage in toner density in the developer container 54Y, the driving motor 41Y is activated by signals from a control unit.

As described earlier, the spiral protrusions 33*a* are formed on the inner surface of the bottle body 33Y of the toner bottle 32Y. Accordingly, as the bottle body 33Y rotates, the toner is conveyed from the bottom part 62Y of the bottle body 33Y to the case 34Y at the head of the bottle body 33Y. Then the toner is discharged from the opening C of the bottle body 33Y, passes through the space in the case 34Y, and is discharged outside the bottle from the toner outlet D.

The toner discharged from the toner bottle 32Y drops to a toner receiving part (not shown) in the toner conveying unit 40Y. The toner receiving part communicates to the toner conveying pipe 43Y. By activating the driving motor 41Y, the bottle body 33Y rotates, and the conveying coil in the toner conveying pipe 43Y rotates. Accordingly the toner that dropped to the toner receiving part is conveyed in the toner conveying pipe 43Y, and is replenished into the toner replenishing unit 58Y in the developing unit 5Y.

As described above, in the image forming apparatus according to the first embodiment, the engaging part 63Y formed at the bottom part 62Y engages with the part 61Y of the bottle housing part 31Y. Moreover, the position of the toner bottle 32Y is fixed in the bottle housing part 31Y by rotating the case 34Y so that the shutter 36Y opens the toner outlet D. Accordingly, a user clearly feels a mechanical click when attaching each toner bottle 32Y, 32M, 32C, and 32K to the apparatus body 100. This prevents the user from failing to properly set the toner bottles 32Y, 32M, 32C, and 32K.

In the present embodiment, only toner is stored in the toner bottles 32Y, 32M, 32C, and 32K. However, in another type of an image forming apparatus in which a two-component developer containing toner and carriers is provided to the developing unit 5, the two-component developer can be stored in the toner bottles 32Y, 32M, 32C, and 32K.

Next an image forming apparatus according to a second embodiment is described below.

In the first embodiment, the engaging part formed at the bottom part of the bottle body engages with the part on the bottle housing part. Moreover, the position of the toner bottle is fixed in the bottle housing part by rotating the case so that the shutter opens the toner outlet. In the second embodiment, ribs are provided in the case of the toner bottle. The ribs prevent gaps from forming between a holder part of the case and the opening of the bottle body that are in close contact with each other. Moreover, the ribs prevent a gap from forming between the holder part of the case and the opening of the bottle body when the case is attached to the apparatus body.

The overall construction of the image forming apparatus according to the present invention is the same as that of the first embodiment as shown in FIG. 1. Moreover, the construction of the image forming unit is the same as that of the first embodiment as shown in FIG. 2. Furthermore, the state of the toner bottle mounted on the bottle housing unit in the image forming apparatus according to the present embodiment is the same that of the first embodiment as shown in FIG. 6.

Figure 14:
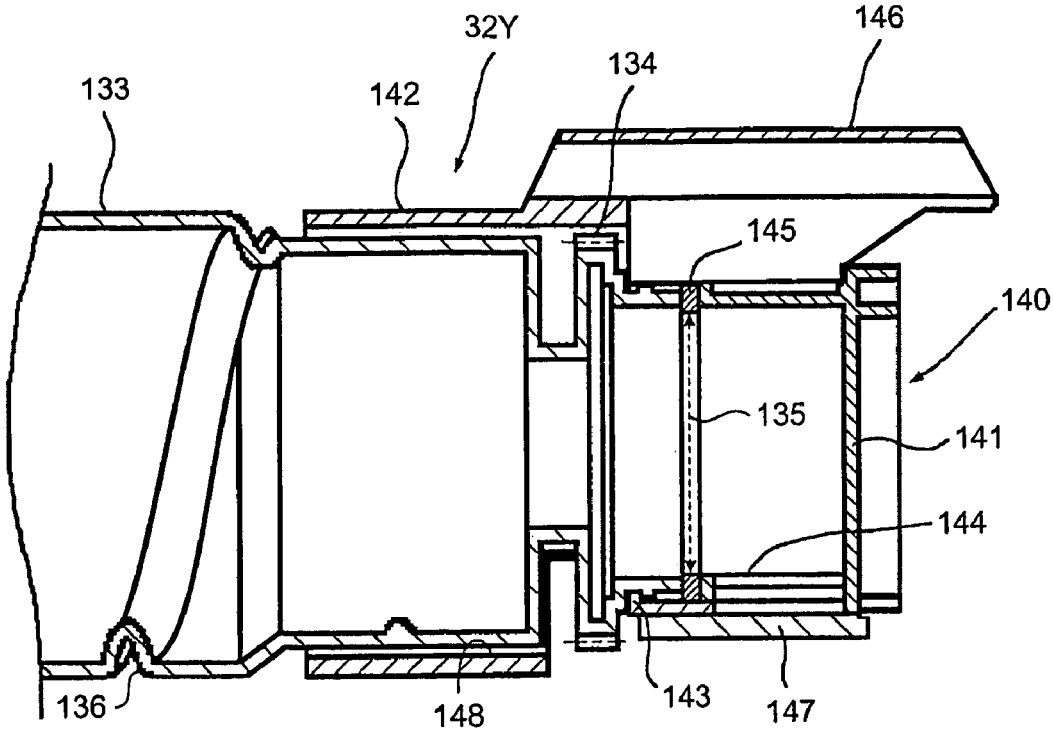
FIG. 14 is an enlarged cross-sectional view of a side of an opening of the toner bottle according to the second embodiment.

FIG. 14 is a cross-sectional view of the top end of the toner bottle 32Y according to the present embodiment.

The three other toner bottles 32M, 32C, and 32K have substantially the same construction as the toner bottle 32Y containing yellow toner, except that each contains a different color toner. Thus, only the toner bottle 32Y containing yellow toner is described below; however, the present embodiment is also applicable to the three other toner bottles 32M, 32C, and 32K.

In FIG. 14, the toner bottle 32Y includes a cylindrical bottle body 133 as a container body. A cylindrical case 140 (bottle cap) functioning as a lid is provided on an opening 135 at the top end of the bottle body 133. The case 140 rotates in relation with the bottle body 133. The bottle body 133 includes spiral protrusions (spiral conveying part) 136 that convey toner towards the opening 135, when the bottle body 133 rotates. The case 140 includes a cap part 141 that has a toner outlet (toner replenishing opening) 144 provided at the bottom of the circumferential surface. A holder part 142 is fixed to the cap part 141, and attaches the cap part 141 to the bottle body 133. A claw part 143 provided on the holder part 142 engages with a gap of the bottle body 133, so that the case 140 and the bottle body 133 are relatively rotated with respect to each other. A seal 145 is provided where the bottle body 133 and the cap part 141 join, to prevent toner from leaking from this part. The holder part 142 of the case 140 includes a handle 146 and a shutter 147. Moreover, a bottle gear 134 is provided near where the case 140 is attached to the bottle body 133. The bottle gear 134 is an input gear used as an input part, and is formed integrally with the bottle body 133.

When attaching the toner bottle 32Y to the apparatus body 100, the cover 30 shown in FIG. 1 is firstly opened upwards to expose the bottle housing unit 31. As shown in FIG. 6, after the toner bottle 32Y is mounted on the bottle housing part 31Y, a user rotates the handle 146. This rotates the case 140 that is formed integrally with the handle 146, and moves the shutter 147 along a circumferential direction on the case 140 so as to open the toner outlet (toner replenishing opening) 144. At the same time, the case 140 and the bottle housing part 31Y are connected and fixed to each other. This mechanism is not the main point of the present invention; thus, a detailed description is omitted. The bottle gear 134 of the toner bottle 32Y set in the bottle housing part 31Y meshes with, and is driven by, the driving gear (not shown) of the apparatus body 100.

On the other hand, when the toner bottle 32Y is detached from the apparatus body 100, a user rotates the handle 146 in an opposite direction. Accordingly, the case 140 is released from the bottle housing part 31Y. At the same time, the shutter 147 closes so as to close the toner outlet (toner replenishing opening) 144. The user holds the handle 146 while he detaches the toner bottle 32Y from the apparatus body 100. Because the toner bottle 32Y can be attached to/detached from the apparatus body 100 from above, the process of replacing the toner bottle 32Y is easy to understand, and easy to carry out. Moreover, because the case 140 has the handle 146, the toner bottle 32Y can be easily fixed to the bottle housing unit 31 by rotating the case 140. When the toner bottle 32Y is detached from the apparatus body 100, the shutter 147 does not open even if the handle 146 of the case 140 is rotated. Thus, when replacing the toner bottle 32Y, the toner is prevented from spilling out by accident, because the shutter 147 is kept shut.

As described above, the handle 146 is held when attaching/detaching the toner bottles 32Y, 32M, 32C, and 32K. Thus, because only one end of the toner bottle 32Y is held, the central rotational axis of the bottle body 133 deviates from that of the case 140. This causes problems such as toner scattering and an increase in driving torque.

Figure 15:
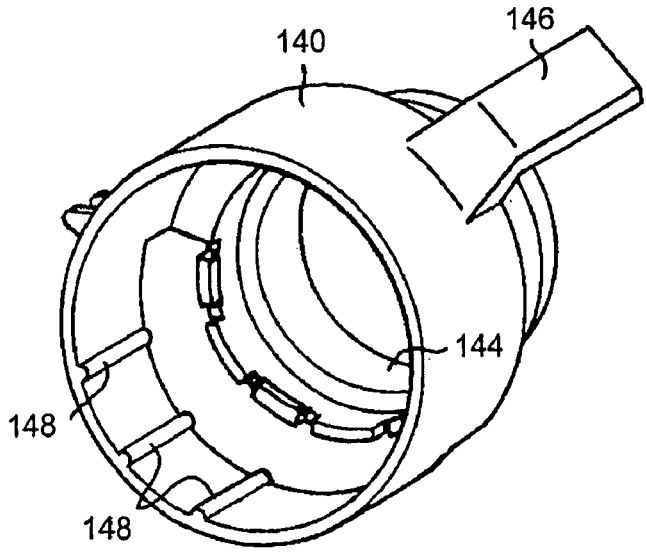
FIG. 15 is a perspective view inside a case (bottle cap) of the toner bottle according to the second embodiment.

Accordingly, in the present invention, ribs 148 are provided on the inner circumferential surface as preventing members, so as to narrow a gap where the bottle body 133 of the toner bottle 32Y overlaps with the case 140. As shown in FIGS. 14 and 15, the ribs 148 are located at a side opposing the handle 146 with respect to the central axis of the case 140.

As described above, the case 140 has ribs 148 provided on the side opposing the handle 146. Accordingly, even when a user holds the handle 146 while rotating the toner bottle 32Y while setting it into the apparatus, and only one end of the toner bottle 32Y is held, the ribs 148 prevent the bottle body 133 from loosening from the case 140. This prevents a gap from being formed between the case 140 and the bottle body 133, so as to prevent toner scattering. Moreover, the case 140 is prevented from falling off, or nearly falling off, from the bottle body 133. This prevents toner scattering and a torque increase. Furthermore, when the bottle body 133 is rotated, the ribs 148 restrict the central rotational axis of the bottle body 133 from deviating too far from a predetermined position, such that a gap is not formed between the opening 135 and the holder part 142. Accordingly, the central rotational axis of the bottle body 133 is kept from deviating largely from the predetermined position, thus preventing a torque increase.

Moreover, because the preventing members are ribs 148, an area of the preventing members contacting the rotating bottle body 133 is small. This reduces torque caused by contacting the bottle body 133.

Figure 16:
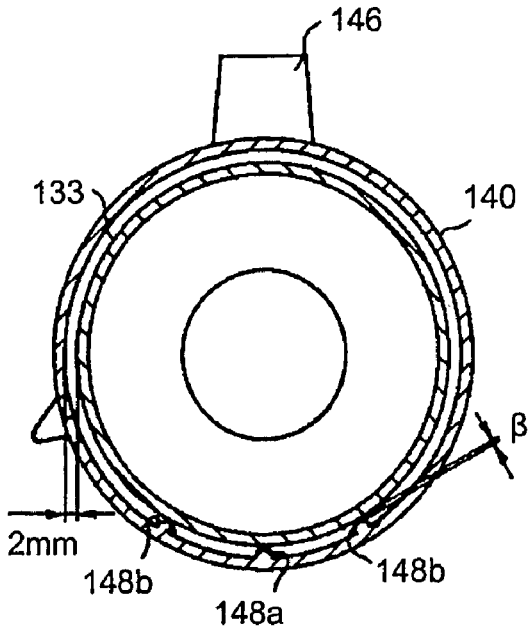
FIG. 16 is a cross-sectional explanatory diagram of a part where a bottle body of the toner bottle and the case overlap, when held, according to another embodiment of the second embodiment.
Figure 17:
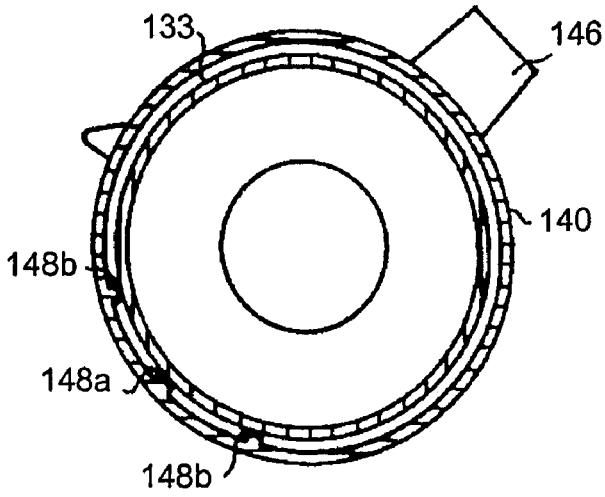
FIG. 17 is a cross-sectional explanatory diagram of the part where the bottle body of the toner bottle and the case overlap, when set, according to the other embodiment of the second embodiment.

Furthermore, according to the present embodiment, there are three ribs 148 extending in parallel to the central axis of the case 140, as shown in FIG. 15 to 17. A rib 148*a* is located opposite to the handle 146, and ribs 148*b* are located on both sides of the rib 148*a*. The rib 148*a* prevents the bottle body 133 from falling off, or nearly falling off, from the case 140, by its own weight. When the toner bottle 32Y is being set in the apparatus, the rib 148*a* and the ribs 148*b* prevent the bottle body 133 from falling off, or nearly falling off, from the case 140, due to a load applied from the handle 146. This prevents toner scattering and a torque increase. The number of ribs 148 is not limited to three; any number of ribs 148 can be provided. However, too many ribs 148 can possibly increase a sliding load when the bottle body 133 rotates; thus, it is preferable to have only a few ribs 148.

Figure 18:
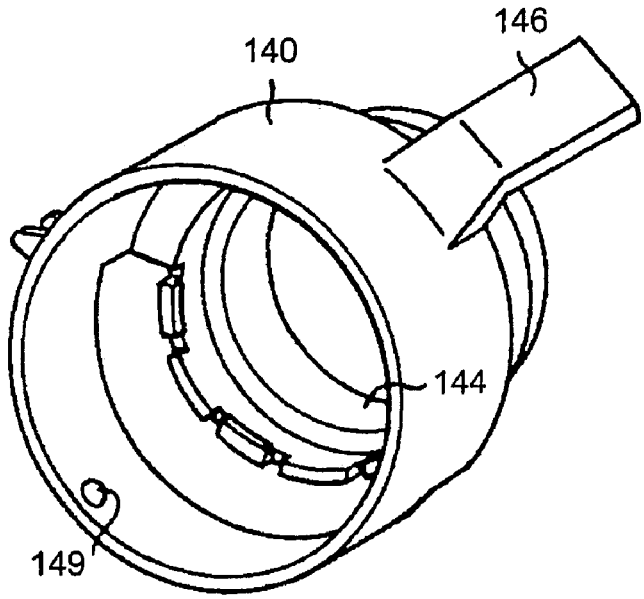
FIG. 18 is a perspective view inside a case of the toner bottle according to still another embodiment of the second embodiment.

FIG. 18 is a perspective view of the case 140 according to another embodiment of the present invention. In the present embodiment, a hemispherical projection 149 is provided as the preventing member at a position opposite to the handle 146, similarly to the rib 148. Because the preventing member is the hemispherical projection 149 provided at the edge of the case 140, an area of the preventing member contacting the rotating bottle body 133 is considerably small. This reduces torque caused by contacting the bottle body 133.

Figure 19:
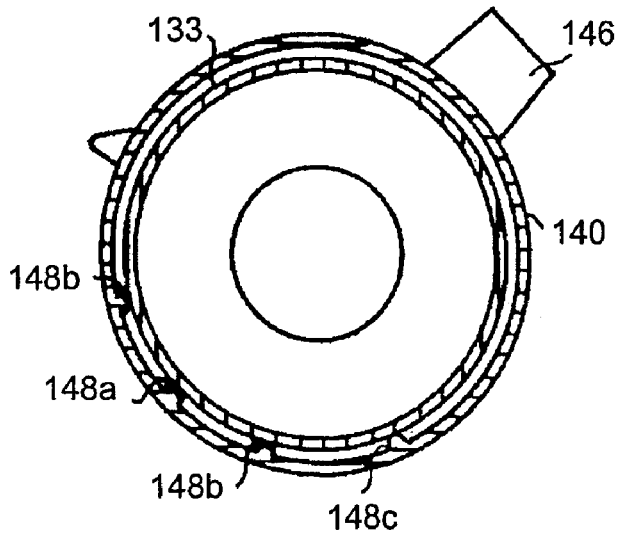
FIG. 19 is a cross-sectional explanatory diagram of the part where the bottle body of the toner bottle and the case overlap, when set, according to the still another embodiment of the second embodiment.
Figure 20:
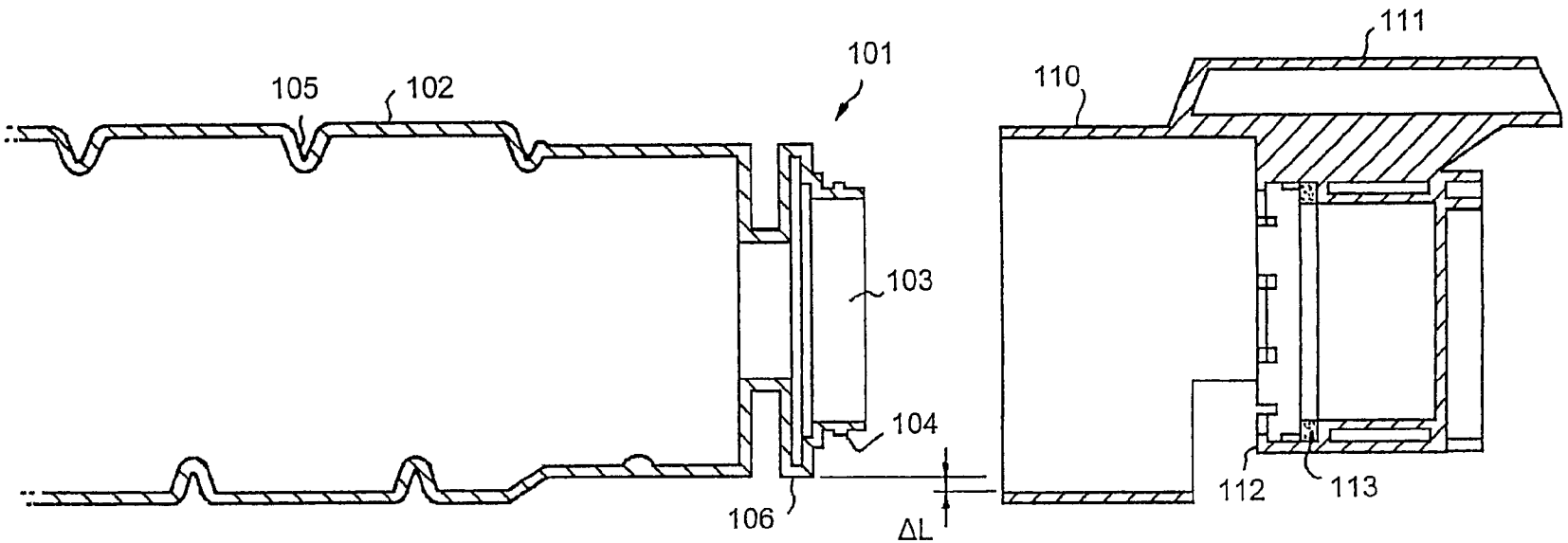
FIG.20 BACKGROUND ART
FIG. 20 is a cross-sectional block diagram of a conventional toner bottle in a separated state.
Figure 21:
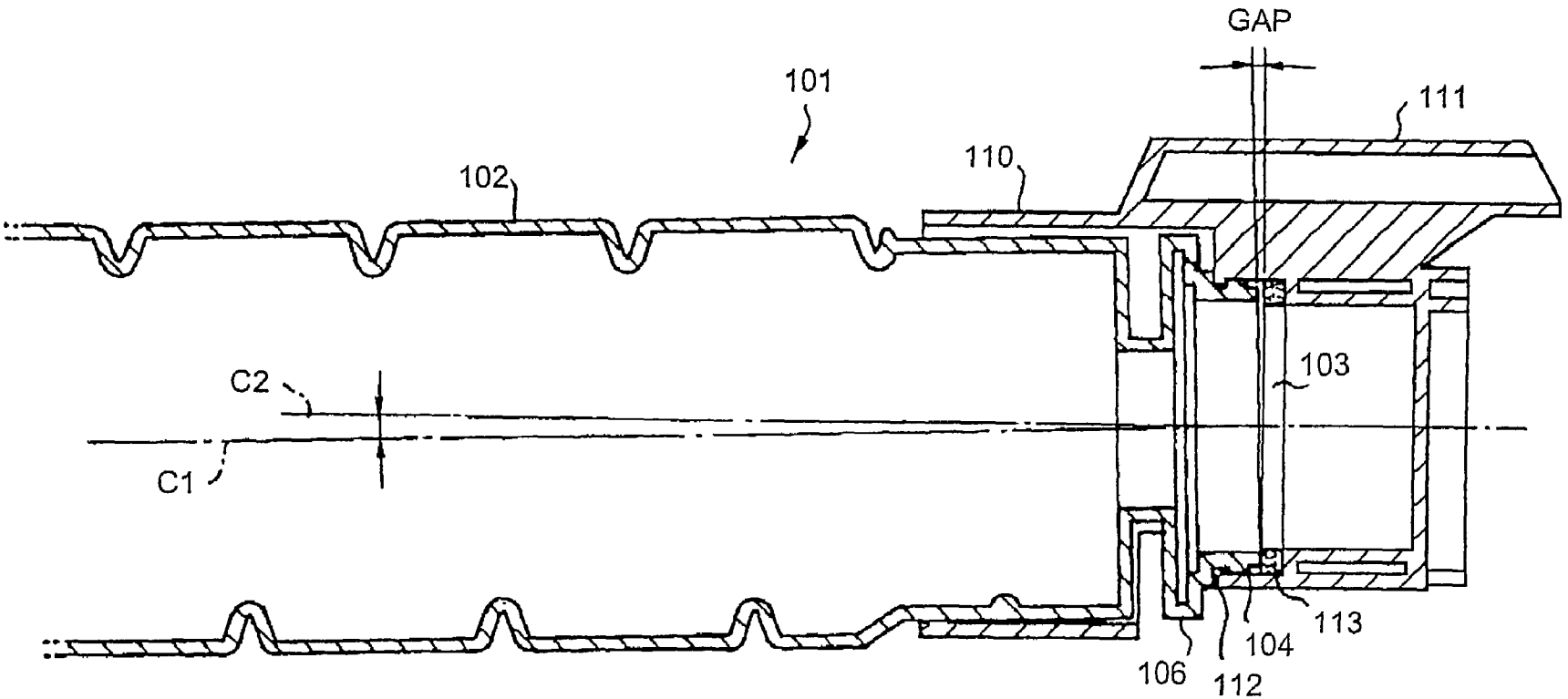
FIG.21 BACKGROUND ART
FIG. 21 is a cross-sectional block diagram of the conventional toner bottle in an assembled state.

Still another embodiment is shown in FIG. 19. To prevent the bottle body 133 from tilting downward by gravity after being set in the apparatus, another rib 148*c* or the projection 149 is preferably provided at a position corresponding to the bottom of the case 140. With this construction, the rib 148*a* and the ribs 148*b* prevent, at three locations, the bottle body 133 from tilting downward when a user holds the handle 146. Moreover, the rib 148*c* prevents the toner bottle body 133 from tilting downward when the bottle is set and driven in the apparatus.

An optimal height of the rib 148 was examined, using ribs of different heights. Results are shown in table 1. The ribs used for this experiment satisfies the following condition: as shown in FIGS. 16 and 17, when the central axis of the bottle body 133 and that of the case 140 are aligned, a gap $\Delta L$ where the bottle body 133 overlaps with the case 140 is 2 mm. Based on this condition, four ribs each forming a gap $\beta$ between the bottle body 133 of 0 mm, 0.5 mm, 1.0 mm, and 1.5 mm, were used.

TABLE 1

| Gapβ (mn) | Toner scattering | Rotatability of toner bottle |
|---|---|---|
| 0 | ○(Does not scatter) | X(Rib rubs toner bottle and increases load) |
| 0.5 | ○(Does not scatter) | ○(Good) |
| 1 | ○(Does not scatter) | ○(Good) |
| 1.5 | X(Scatters) | X(Axis shifts and increases load) |

As shown in Table 1, the ribs that form a gap β of 1 mm and 0.5 mm did not cause toner scattering, and rotatability of the container was good. The rib that forms a gap β of 0 mm did not cause toner scattering but deteriorated the rotatability of the container due to a large load caused by the rib 148 rubbing against the toner bottle. Moreover, the rib that forms a gap β of 1.5 mm caused toner scattering and deteriorated the rotatability of the container because the central axis shifted and increased the rotating load.

The results say that when the gap ΔL is 2 mm, the height of the rib 148 is preferably about 1 mm to 1.5 mm.

Favorable embodiments of the present invention are described above. However, the present invention is not limited to these embodiments, and various changes can be made.

For example, in the second embodiment, the toner bottle was taken as an example of the powder container. However, the powder container is not limited to the toner bottle; the powder container can be a container for storing a developer that is a mixture of toner and carriers, or just carriers.

As described above, in the image forming apparatus according to the second embodiment, the case 140 includes ribs 148 that prevent a gap from forming between the holder part 142 and the opening 135 that are in close contact with each other. Moreover, the ribs 148 prevent a gap from forming between the holder part 142 and the opening 135 when the case 140 is attached to the apparatus body 100. Accordingly, even when a user holds the handle 146 while setting the toner bottle into the apparatus, and only one end of the toner bottle is held, the ribs 148 prevent the bottle body 133 from loosening from the case 140. This prevents a gap from being formed between the case 140 and the bottle body 133, so that toner scattering is prevented. Moreover, after the case 140 is set in the predetermined position of the apparatus body 100, the case 140 is rotated to be engaged with the engaging part of the apparatus body 100. Furthermore, when the bottle body 133 is rotated, the ribs 148 restrict the central rotational axis of the bottle body 133 from deviating too far from a predetermined position, such that a gap is not formed between the opening 135 and the holder part 142. Accordingly, the central rotational axis of the bottle body 133 is kept from deviating largely from the predetermined position, thus preventing a torque increase.

The present invention is not limited to these embodiments. It is clear that various changes may be made without departing from the scope of the present invention. Moreover, the numbers of components, positions, shapes are not limited to these embodiments, and may be changed to preferable numbers of components, positions, shapes to carry out the present invention.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

The invention claimed is:

1. A powder container that can be detachably installed in a container housing unit of an image forming apparatus, the powder container comprising:

a container body including an opening located at a head of the container body;

a fitting part extending from an end of the powder container and configured to fit around a counterpart on the container housing unit such that, when a user rotates the container body on the container housing, the counterpart on the container housing abuts the fitting part to block the rotation of the container body; and an engaging part located at a bottom of the container body, the engaging part configured to be engaged with an engagement receiving part of the container housing unit;

a drive transferring member that rotates integrally with the container body; and a lid including a discharge outlet that further discharges powder discharged from the opening of the container body; and a shutter that opens and closes the discharge outlet, wherein a position of the powder container in the container housing unit is determined by engaging the engaging part with the engagement receiving part, and operating the lid such that the shutter opens the discharge outlet.

2. The powder container according to claim 1, wherein the engaging part is formed in a concave and circular shape.

3. The powder container according to claim 1, wherein the engagement receiving part is formed in a convex shape.

4. The powder container according to claim 1, wherein the lid includes the fitting part that fits to the counterpart of the container housing unit in conjunction with opening of the discharge outlet.

5. The powder container according to claim 1, wherein the drive transferring member is a gear located on a circumferential surface of the container body and on a side of the opening.

6. The powder container according to claim 1, wherein the container body includes a spiral protrusion on an inner circumferential surface.

7. The powder container according to claim 1, wherein the container body stores toner.

8. The powder container according to claim 7, wherein the container body further stores a carrier.

9. The powder container according to claim 1, wherein the container body includes a handle configured to be grasped by the user.

10. An image forming apparatus comprising:

a powder container that includes a container body including an opening located at a head of the container body;

a fitting part extending from an end of the powder container and configured to fit around a counterpart on a container housing unit such that, when a user rotates the container body on the container housing, the counterpart on the container housing abuts the fitting part to block the rotation of the container body; and an engaging part located at a bottom of the container body, the engaging part being engaged with an engagement receiving part of the container housing unit;

a drive transferring member that rotates integrally with the container body; and a lid including a discharge outlet that further discharges powder discharged from the opening of the container body; and a shutter that opens and closes the discharge outlet, wherein a position of the powder container in the container housing unit is determined by engaging the engaging part with the engagement receiving part, and operating the lid such that the shutter opens the discharge outlet, the powder container is detachably installed in the container housing unit, and the container housing unit includes the engagement receiving part with which the engaging part of the powder container is engaged.

11. The image forming apparatus according to claim 10, wherein the container housing unit includes the counterpart to which the fitting part of the lid fits in conjunction with opening of the discharge outlet.

12. The image forming apparatus according to claim 10, wherein the image forming apparatus includes a driving unit that transfers a drive to the drive transferring member.

13. The image forming apparatus according to claim 10, wherein the container body includes a handle configured to be grasped by the user.

14. A powder container, comprising:

a container body including a conveying part that conveys powder stored in the container body towards an opening of the container body; and a lid that supports the container body such that the container body is rotatable, and discharges the powder discharged from the opening through a discharge outlet, wherein the lid includes a handle configured to be grasped by a user;

a contacting part that makes a contact with the opening; and a preventing part that prevents a gap from forming between the opening and the contacting part, wherein the preventing part is a rib that is parallel to an axial direction of the powder container, and is positioned opposite to the handle with respect to a rotational central axis, and wherein the powder container is installed in an image forming apparatus by fixing the lid to the image forming apparatus.

15. The powder container according to claim 14, wherein the lid is rotated to be engaged with an engaging part of the image forming apparatus after being set in a predetermined position of the image forming apparatus to install the powder container in the image forming apparatus, and the preventing part prevents the gap from forming between the opening and the contacting part by restricting the rotational central axis of the container body from being deviated from a predetermined position when the lid is rotated by more than a predetermined amount.

16. The powder container according to claim 15, wherein the lid includes a handle configured to be grasped by a user, and the preventing part is hemispherical, and is positioned opposite to the handle with respect to the rotational central axis on an edge of the lid near the container body.

17. The powder container according to claim 14, wherein a plurality of preventing parts is provided.

18. An image forming apparatus, comprising:

a powder container that includes a container body including a conveying part that conveys powder stored in the container body towards an opening of the container body; and a lid that supports the container body such that the container body is rotatable, and discharges the powder discharged from the opening through a discharge outlet, wherein the lid includes a handle configured to be grasped by a user;

a contacting part that makes a contact with the opening; and a preventing part that prevents a gap from forming between the opening and the contacting part, wherein the preventing part is a rib that is parallel to an axial direction of the powder container, and is positioned opposite to the handle with respect to a rotational central axis, the powder container in which toner is contained can be installed in the image forming apparatus, and the powder container is installed in an image forming apparatus by fixing the lid to the image forming apparatus.

19. The powder container according to claim 18, wherein the lid is configured to be rotated to be engaged with an engaging part of the image forming apparatus after being set in a predetermined position of the image forming apparatus to install the powder container in the image forming apparatus, and the preventing part prevents the gap from forming between the opening and the contacting part by restricting a rotational central axis of the container body from being deviated from a predetermined position when the lid is rotated by more than a predetermined amount.

20. The powder container according to claim 19, wherein the preventing part is hemispherical, and is positioned opposite to the handle with respect to the rotational central axis on an edge of the lid near the container body.

* * * * *